United States Patent [19]

Cole et al.

[11] 4,057,399

[45] Nov. 8, 1977

[54] PROCESS FOR DEWATERING CARBONACEOUS MATERIALS

[75] Inventors: Edward L. Cole, Fishkill; Howard V. Hess, Glenham; William F. Franz, Gardiner, all of N.Y.

[73] Assignee: Texaco Inc., New York, N.Y.

[21] Appl. No.: 556,516

[22] Filed: Mar. 7, 1975

[51] Int. Cl.[2] ..... C10L 9/00; C10L 10/00

[52] U.S. Cl. ..... 44/6; 44/1 B; 302/14

[58] Field of Search ..... 44/1 R, 1 G, 6; 241/17; 302/14, 66

[56] References Cited

U.S. PATENT DOCUMENTS

| | | | |
|---|---|---|---|
| 2,830,769 | 4/1958 | Work | 241/17 X |
| 3,359,040 | 12/1967 | Every et al. | 302/14 |
| 3,660,054 | 5/1972 | Rieve | 44/1 R |

FOREIGN PATENT DOCUMENTS

| | | | |
|---|---|---|---|
| 32,607 | 6/1970 | Australia | 44/1 G |

*Primary Examiner*—Carl F. Dees

*Attorney, Agent, or Firm*—Thomas H. Whaley; Carl G. Ries; Henry W. Archer

[57] ABSTRACT

Water is removed from carbonaceous materials such as coal by treatment with a hydrocarbon at elevated temperatures and a pressure sufficiently high to maintain the system liquid.

5 Claims, 1 Drawing Figure

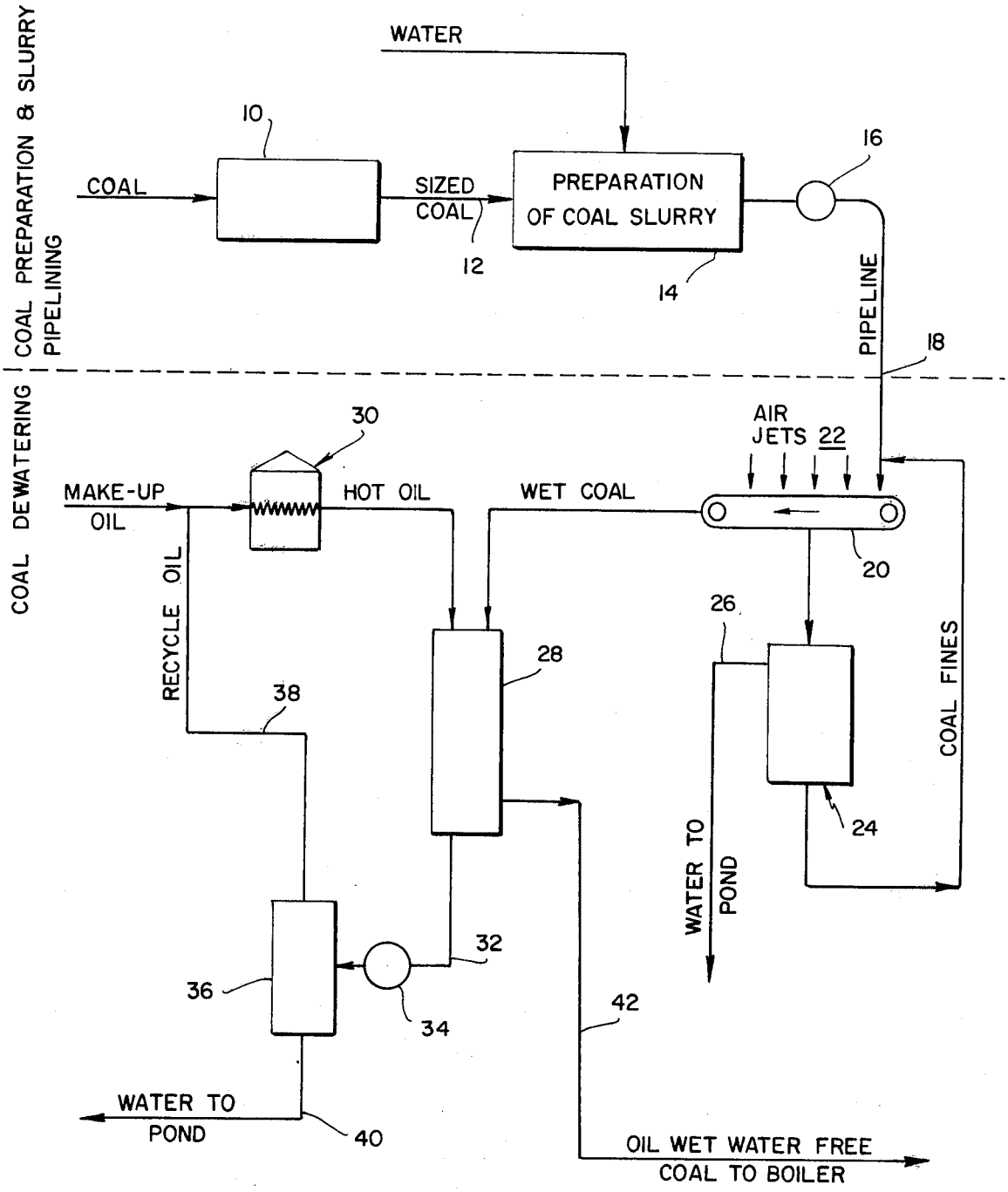
COAL PREPARATION & SLURRY PIPELINING
COAL DEWATERING
WATER
COAL
10
SIZED COAL
12
PREPARATION OF COAL SLURRY
14
16
PIPELINE
18
30
MAKE-UP OIL
HOT OIL
WET COAL
AIR JETS 22
20
RECYCLE OIL
38
28
26
24
COAL FINES
WATER TO POND
32
36
34
42
WATER TO POND
40
OIL WET WATER FREE COAL TO BOILER

PROCESS FOR DEWATERING CARBONACEOUS MATERIALS

BACKGROUND OF THE INVENTION

1. Field of the Invention

This invention relates to a process for removing water from carbonaceous materials and is particularly applicable to the dewatering of water-slurried coal although it may also be used as a means of mine-mouth beneficiation and for the separation of water from other solid organic materials containing same.

2. Analysis of the Prior Art

Pipelining coal as a slurry is being done successfully but experts in the field feel there is no practical method of slurry utilization. The coal slurry in question contains 40–60 percent of water and feeding this material directly to a boiler results in a large heat loss and makes the down stream separation of particulates difficult due to increased exhaust gas (steam, $CO_2$, etc.) volumes. One coal-slurry dewatering plant dries the coal by the successive steps of vacuum filtration followed by thermal drying with flue gas-air mixture in a lift-pipe. The coal is effectively dried but energy costs are high and the dry coal dusts extensively despite the use of cyclones. Thus the hazards of atmospheric pollution are substantial. In another method the coal is dewatered to 15–10 percent water content by the use of centrifuges. The use of centrifuges in this service are accompanied by high investment and service costs plus the fact that the coal is only somewhat more than 50 percent dewatered. Obviously, this lower water content is an advantage over feeding the slurry directly to the boilers but the advantages of high energy costs and high concentrations of steam in the exhaust gases remain.

The prior art is also aware of the technology described in coassigned U.S. Pat. Nos. 2,999,741 and 3,846,087. These patents are concerned with the removal of soot from the quench water used in the production of synthesis gas. In accordance with the methods of those patents, the quench water containing only 1 to 2 percent of carbon is extracted with a liquid hydrocarbon mixture at a pressure of about 250 psig and 2500° F. In the process of U.S. Pat. No. 3,552,031 moist solid organic material is subjected to a temperature of 240° to 260° C. and a pressure between the saturation pressure and 500 psig to separate liquid water from such material while the material is under such pressure.

SUMMARY OF THE INVENTION

In one of its more specific aspects, this invention is directed to a process for separating carbonaceous solids from water wherein the solids are separated by contact with a hydrocarbon at a temperature range of 300° F to 705° F, at a pressure sufficient to keep the hydrocarbon and water liquid but below 3500 psig, the amount of hydrocarbon used being from 20 to 500 weight percent basis carbonaceous material, followed by separating the hydrocarbon with dissolved and free water from the oil wet carbonaceous material. Hydrocarbons suitable for this process include light hydrocarbon oils such as kerosine, gas oil, pentanes, benzol, toluene, crudes, topped crudes, asphalt and the like.

DETAILED DESCRIPTION OF THE INVENTION

Having set forth its general nature, the invention will be best understood from the more detailed description hereinafter which refers to the accompanying drawing showing diagrammatically one arrangement for practicing the invention.

As shown in the drawing, carbonaceous material such as coal is sized in grinder or ball mill (10) to give a sized coal having a sieve analysis in the range of minus 8 mesh.

The sized coal is flowed through pipe 12 into mixer 14 where it is slurried with 40 to 70 percent of water or enough water to form a flowable slurry.

The slurry is pumped by pump 16 through pipeline 18 to a wire mesh dewatering screen belt 20 where the mesh is from 20 to 100 and air blown by jets 22. Water and fines pass through the screen into separator vessel 24 and the fines recycled for recovery through pipe 25. The water is discarded through pipe 26. Carbonaceous material is conveyed to dewatering tube or zone 28 and mixed with hydrocarbon oil which has been previously heated in heater 30 and charged downflow at a temperature of between 300° and 705° F at a pressure of less than 3500 psig. A back pressure regulator (not shown) was used to maintain this pressure. The hydrocarbon-water fraction is continuously withdrawn through line 32 and cooled in exchanger 34 and passed into separator 36. Separated oil is recycled through tube 38 and the water discharged to a pond through tube 40. The oil-wet but water free coal is flowed to a boiler through pipe 42. The oil can be removed by draining but at this point it contains less than 5 percent of water.

With the present invention a coal of low water content is secured without the hazards of polluting the atmosphere, the use of centrifuges is avoided, energy costs are reduced and the method is applicable to coals of various sizes.

A further advantage of dewatering coal by this technique is that this layer of oil acts to prevent oxidation during storage (See U.S. Pat. No. 3,754,876.)

The invention is further illustrated in an nonlimiting sense by the following examples.

EXAMPLE I

A Wyoming sub-bituminous coal (Lake DeSmet) was found to have the following composition:

| Proximate Analysis | |
|---|---|
| Moisture, % | 19.5 |
| Ash, % | 28.4 |
| Volatile Matter, % | 28.3 |
| Fixed Carbon, % | 23.8 |
| Total | 100 |

| Ultimate Analysis | |
|---|---|
| Moisture, % | 19.5 |
| Carbon, % | 39.4 |
| Hydrogen, % | 3.4 |
| Nitrogen, % | 0.6 |
| Sulfur, % | 1.4 |
| Ash, % | 28.4 |
| Oxygen, % | 7.3 |
| Total | 100 |
| Heat of Combustion, BTU/lb. | |
| Gross | 5,936 |
| Net | 5,628 |

EXAMPLE II

The Lake DeSmet Coal of Example I had the following sieve analysis:

(U.S. Standard Series, Tyles)

| Sieve Designation | Parts Retained On Sieve, By Wt. |
|---|---|
| 10 | 169 |
| 20 | 156 |
| 30 | 50 |
| 40 | 41 |
| 60 | 24 |
| 100 | 27 |
| Pan | 32 |
| | 499 |

The coarse mesh coal was recycled to a ball mill with fresh unground coal to give a coal having the following sieve analysis.

| Sieve Designation | Parts Retained On Sieve, By Wt. |
|---|---|
| 10 | 2 |
| 20 | 88 |
| 30 | 57 |
| 40 | 54 |
| 60 | 35 |
| 100 | 71 |
| Pan | 198 |
| TOTAL | 505 |

500 parts by weight of the above coal was slurried with 240 parts by volume of water to give a coal for pipelining. Following pipelining, the coal was dewatered. In the first stage the pipeline slurry was flowed into a 30-mesh screen and air blown. About 123 parts of water and fine passed through the 30-mesh screen. The settled coal fine were recycled to the screen, the coarse coal on the screen acted as a pre-coat thus allowing substantially all of the coal fines to be recovered. The drained coal was charged to the dewatering tube. The following data was secured.

554 parts wet coal were charged to the dewatering tower where an Arabian Vacuum Gas Oil boiling between 650°–1000° F. was charged downflow over the wet coal at 600° F. (at 600° F water has a vapor pressure of 1593 psi.) and 2000–2150 psig. A back pressure regulator was used to maintain this pressure. The following hourly fractions were recovered.

| Cut # | Wt. Grams | Vol. of Water |
|---|---|---|
| 1 | 310 | 85+ Emulsion |
| 2 | 443 | 35+ Emulsion |
| 3 | 468 | 12+ Emulsion |
| 4 | 404 | 6+ Emulsion |
| 5 | 452 | 4+ Emulsion |
| 6 | 565 | 2 |

The coal was cooled to 200° F and the oil drained off. It was found that the coal contained 25.4 percent of oil and 0.1 percent of water. On an oil free basis, this is 0.13 percent. This represents 98 percent disappearance of water from the coal slurry using the processing scheme as outlined in the flow diagram.

EXAMPLE III

A California lignite was found to have the following composition.

| Proximate Analysis | |
|---|---|
| Moisture, % | 37.2 |
| Ash, % | 18.9 |
| Volatile Matter, % | 32.2 |

-continued

| Proximate Analysis | |
|---|---|
| Fixed Carbon, % | 11.7 |
| Total | 100.0 |

| Ultimate Analysis | |
|---|---|
| Moisture, % | 37.2 |
| Carbon, % | 19.2 |
| Hydrogen, % | 4.3 |
| Nitrogen, % | 0.5 |
| Sulfur, % | 0.9 |
| Ash, % | 18.6 |
| Oxygen, % | 19.3 |
| Total | 100.00 |
| Gross Heat of Combustion, BTU/LB. 5,127. | |

EXAMPLE IV 500 ml (344 parts by wt.) of lignite, Example III, was placed in a vertical tube reactor. The void space above and below the lignite was filled with Berl saddles and air in the reactor was displaced with a kerosine fraction boiling between 338°–514° F. The reactor was heated to 500° F. A backpressure regulator was set at 1500 psig and kerosine was pumped downflow through the reactor. The following data was secured.

| | Time | Temp. ° F. | Vol. Kerosine Layer at RT | Vol. Water Layer at RT | Vol. % Water Layer |
|---|---|---|---|---|---|
| Start | 1935 | 500 | | | |
| Pump | 2035 | 505 | 130[1] | 33 | 20.2 |
| | 2135 | 550 | 175 | 19 | 9.8 |
| | 2235 | 545 | 320 | 38 | 10.3 |
| | 2335 | 548 | 435 | 7 | 1.6 |
| | 0035 | 550 | | | |
| | 0135 | 550 | 730 | 24 | 3.2 |
| | 0235 | 550 | | | |
| | 0335 | 550 | | | 1.9 |
| | 0435– | 550 | 410 | 8 | |
| | 1735 | | 7000 | Trace | |

[1]Includes volume obtained during heatup.

The kerosine wet coal was found to contain 0.92% water.

A portion of the kerosine wet coal was washed with n-pentane to free the coal of kerosine. The coal was then air dried to strip off the n-pentane. The coal was found to contain 1.5% moisture. Thus the moisture was reduced from 37.2 percent to 1.5, a reduction of 94 percent.

EXAMPLE V 435 parts of sub-bituminous coal, Example I, was placed in a vertical tube reactor. The reactor system filled with mixed xylenes and heated to 500° F. The pressure was 1000 psig. Started pumping mixed xylenes at a rate of 500 ml. per hour and the temperature raised to 550° F in one hour. Pressure was 2500 psig and this was maintained by a backpressure regulator. A total of 6600 parts by vol. of mixed xylenes was passed through the unit at 550° F. The unit was cooled down and drained to remove xylene. The composite coal sample had 0.30 percent water by Karl Fischer analysis.

The process is designed to operate continuously by using several dewatering towers on a cyclic basis. Thus, while one tower is being loaded another is on the dewatering cycle, and another is being unloaded. The means for dewatering the coal may be some number different than the three towers cited above or the means may be a single tower with counter-current or co-current oil-coal feeds with or without internal screw conveyors. Various dewatering means such as vibratory screens or filter can be employed to remove water from the charge to vessel 28.

The coal from the dewatering zone is oil-wet, for example with Arabian Vacuum Gas Oil. By draining the coal at different temperatures or washing with light hydrocarbons the concentration of oil on the coal may be reduced. Such a washing step would not be necessary or desirable because burning a small amount of occluded hydrocarbon would add to the heat of combustion of the mixure. In Example II, means are provided to supply make-up oil to the system. Feeding the hot dewatered coal directly to the boiler is advantageous as the sensible heat of the hot coal is conversed in this manner.

The present invention has been disclosed herein with particular respect to certain preferred embodiments thereof. It should be understood, however, that other embodiments are comprehended within the scope of the present invention without particular discussion thereof.

What is claimed is:

1. A process for the transportation and subsequent dewatering of a solid carbonaceous material which comprises grinding said material to particles capable of passing through an 8 mesh sieve, slurrying the resulting particulate material with water, passing the slurry through a pipeline and then separating the slurry into water and water-wet particles by pumping the slurry to a dewatering screen belt, air-blowing the water-wet particles, mixing said air-blown water-wet particles with a hydrocarbon liquid in an amount between 20 and 500 weight percent basis particulate material, heating the mixture to a temperature between 300° and 705° F. at a pressure between 100 and 3500 psig sufficient to maintain the hydrocarbon and water in the liquid phase and then recovering oil-wet but substantially waterfree solid carbonaceous particles from the mixture.

2. The process of claim 1 wherein said carbonaceous material is coal.

3. The process of claim 1 wherein said hydrocarbon is a gas oil, kerosine, naphthas or mixture thereof.

4. The process of claim 1 in which the water-wet particulate material is mixed under cocurrent flow conditions with the hydrocarbon liquid at a temperature between 300° and 705° F. in a separation zone thereby effecting separation into a water-oil emulsion and oil-wet water-free particulate material.

5. The process of claim 1 in which the said solid carbonaceous material is lignite.

* * * * *